US005481286A

United States Patent [19]

Kagayama

[11] Patent Number: 5,481,286

[45] Date of Patent: Jan. 2, 1996

[54] IMAGE FORMING APPARATUS HAVING STAGGERED APERTURE ELECTRODES THAT UNIFORMLY SUPPLY TONER TO FORM AN IMAGE

[75] Inventor: Shigeru Kagayama, Owariasahi, Japan

[73] Assignee: Brother Kogyo Kabushiki Kaisha, Nagoya, Japan

[21] Appl. No.: 207,210

[22] Filed: Mar. 8, 1994

[30] Foreign Application Priority Data

May 31, 1993 [JP] Japan ..... 5-128726

[51] Int. Cl.[6] ..... B41J 2/415

[52] U.S. Cl. ..... 347/55

[58] Field of Search ..... 347/55

[56] References Cited

U.S. PATENT DOCUMENTS 3,689,935 9/1972 Pressman et al. ..... 347/55

4,860,036 8/1989 Schmidlin ..... 347/55

5,036,341 7/1991 Larsson ..... 347/55

FOREIGN PATENT DOCUMENTS 4-141454 5/1992 Japan ..... 347/55

*Primary Examiner*—Joan H. Pendegrass

*Attorney, Agent, or Firm*—Oliff & Berridge

[57] ABSTRACT

In an image forming apparatus, a cylindrical back electrode roller is rotatably disposed at the upper side of an aperture electrode member, and a toner carry roller of a toner supply device is disposed along the longitudinal direction of the aperture electrode member at the lower side of the aperture electrode member. The aperture electrode member includes an insulating sheet, two arrays of apertures formed in the sheet, and control electrodes of approximately 1 μm thickness, each of which is formed at the edge portion of the opening of each aperture on the sheet. Representing a line connecting the center of the toner carry roller and the center of the back electrode roller by L, the center portion of the gap between the two aperture arrays is set to locate on the line L. So, print density can be improved, and an image can be formed with high image quality.

19 Claims, 4 Drawing Sheets

IMAGE FORMING APPARATUS HAVING STAGGERED APERTURE ELECTRODES THAT UNIFORMLY SUPPLY TONER TO FORM AN IMAGE

BACKGROUND OF THE INVENTION

1. Field of the Invention

This invention relates to an image forming apparatus for use in a copying machine, a printer, a plotter, a facsimile machine, or similar machine.

2. Description of Related Art

One image forming apparatus that has been conventionally known is an image forming apparatus disclosed in U.S. Pat. No. 3,689,935, which uses an electrode having plural opening portions (hereinafter referred to as "apertures ") formed therein. In this image forming apparatus, a voltage is applied to the electrode on the basis of image data to control the passage of toner particles through the apertures. An image (toner image) is formed on a supporter with the passed toner particles.

This image forming apparatus includes an aperture electrode member comprising an insulating flat plate, a reference electrode having a continuous body formed on one surface of the flat plate, plural control electrodes, which are insulated from one another, formed on the other surface of the flat plate, and at least one array (row) of apertures, each of which is formed in correspondence with each control electrode so as to be penetrated through the flat plate, the reference electrode and the control electrode. The image forming apparatus further includes means for selectively applying potential across the reference electrode and each of the control electrodes. Also provided are means for supplying charged toner particles so that the flow of the toner particles passed through the apertures is modulated on the basis of the applied potential and means for positioning the supporter in a particle-flow passage so that the supporter and the aperture electrode member are relatively movable.

However, in the above conventional image forming apparatus, the apertures or the opening portions are arranged in a row so that print density cannot be sufficiently heightened. In addition, when plural arrays (rows) of apertures or opening portions are used to heighten the print density, the density of an image on each line (in correspondence with each row of apertures) is different from that on another line. Thus, image quality is lowered.

SUMMARY OF THE INVENTION

An object of the present invention is to provide an image forming apparatus by which print density can be heightened and a high-quality image can be formed.

To attain the above and other objects, the image forming apparatus according to this invention comprises a carrier for carrying and supplying charged toner particles and a toner flow control means disposed to confront the carrier through the charged toner particles. The apparatus has a plurality of arrays of control units including openings and control electrodes provided around the openings. Each control unit is disposed at a predetermined interval, and each array extends in a direction perpendicular to a feeding direction of an image receiving member. A back electrode is disposed to confront with the toner flow control means through the image-receiving member. The toner flow control means is disposed between the back electrode and the carrier so that a distance from one array of control units to a line connecting a center of the carrier and a center of the back electrode and a distance from another array of control units to the line is the same.

In the image forming apparatus according to this invention, since the toner flow control means is disposed between the back electrode and the carrier so that the distance from one array of control units to the line connecting the center of the carrier and the center of the back electrode and the distance from another array of control units to the line is same, the toner can be uniformly supplied to each control unit. Further, the contact of the carrier and the toner flow control means is made uniform. Thus, no dispersion in pressure occurs in this contacting state. Accordingly, a high-quality image having uniform density can be formed.

As is apparent from the foregoing, according to the image forming apparatus of this invention, an image having high print density and high image quality can be formed.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

Preferred embodiments according to this invention are described with reference to the accompanying drawings.

Figure 1:
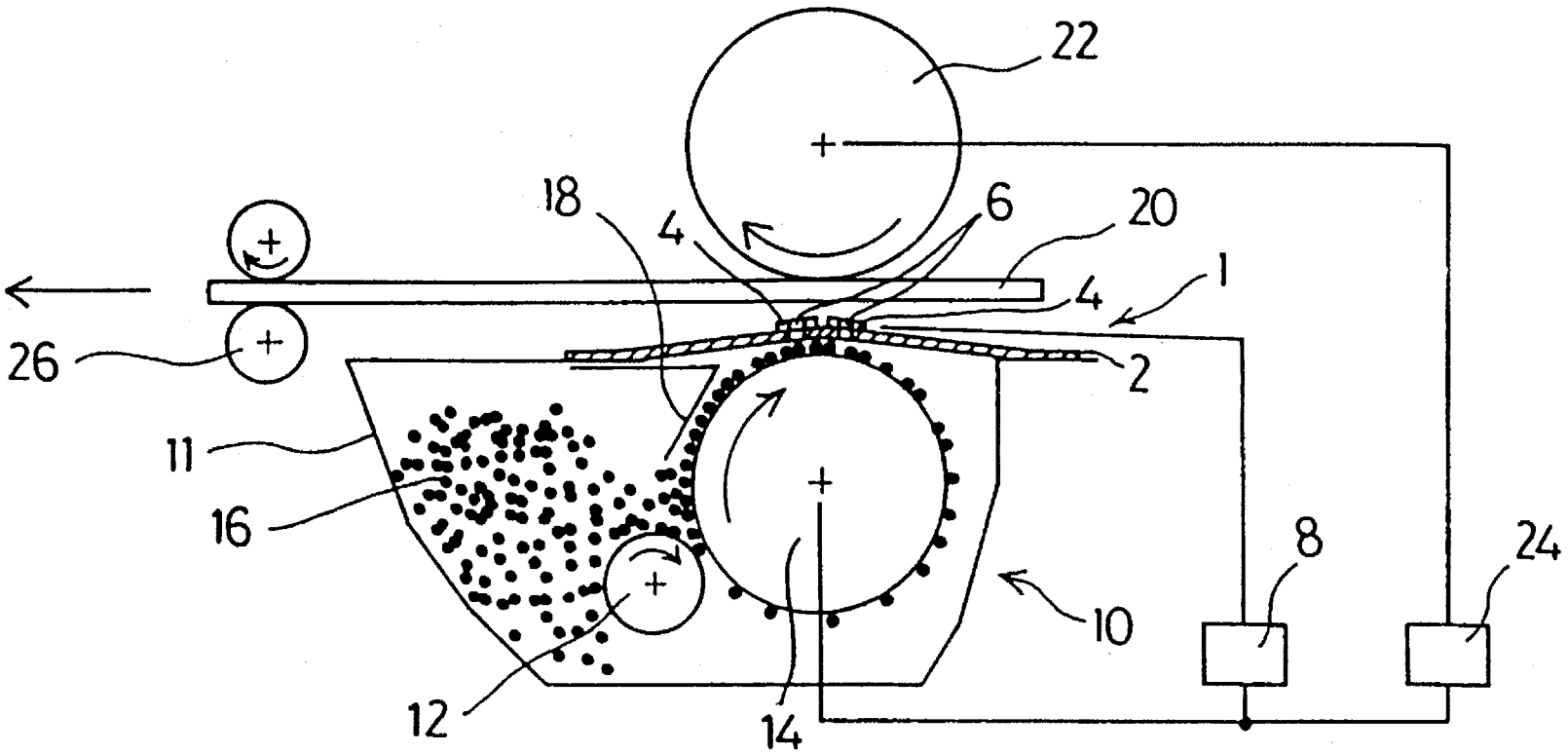
FIG. 1 is a schematic side view showing the construction of an image forming apparatus of the preferred embodiment.

FIG. 1 schematically shows the image forming apparatus according to the preferred embodiment. A cylindrical back electrode roller 22 serving as a counter electrode is rotatably mounted to a chassis (not shown) at the upper side of an aperture electrode member 1 serving as an electric field control means to keep a 1 mm gap interval from the aperture electrode member 1. A printing medium 20 is inserted into the gap of 1 mm and is fed through the gap. Further, a toner supply device 10 is disposed along the longitudinal direction of the aperture electrode member 1 at the lower side of the aperture electrode member 1. A fixing device 26 is disposed at the downstream side of the travelling direction of the printing medium 20, which is fed by the back electrode roller 22.

The toner supply device 10 includes a toner case 11 serving as a housing for the whole apparatus, toner 16 accommodated in the toner case 11, a supply roller 12, a toner carry roller 14, and a toner-layer adjusting blade 18. The toner carry roller 14 carries the toner 16 thereon and feeds the toner toward the aperture electrode member 1. The supply roller 12 supplies the toner 16 to the toner carry roller 14.

The supply roller 12 and the toner carry roller 14 are rotatably mounted in the directions as indicated by arrows of FIG. 1 respectively, and are disposed in parallel to and in contact with each other. The toner layer adjusting blade 18 adjusts the toner amount of the toner 16 carried on the toner carry roller 14 so that the toner is uniform on the roller surface, thereby uniformly charging the toner 16. The toner layer adjusting blade 18 contacts with the toner carry roller 14 under pressure.

Figure 2:
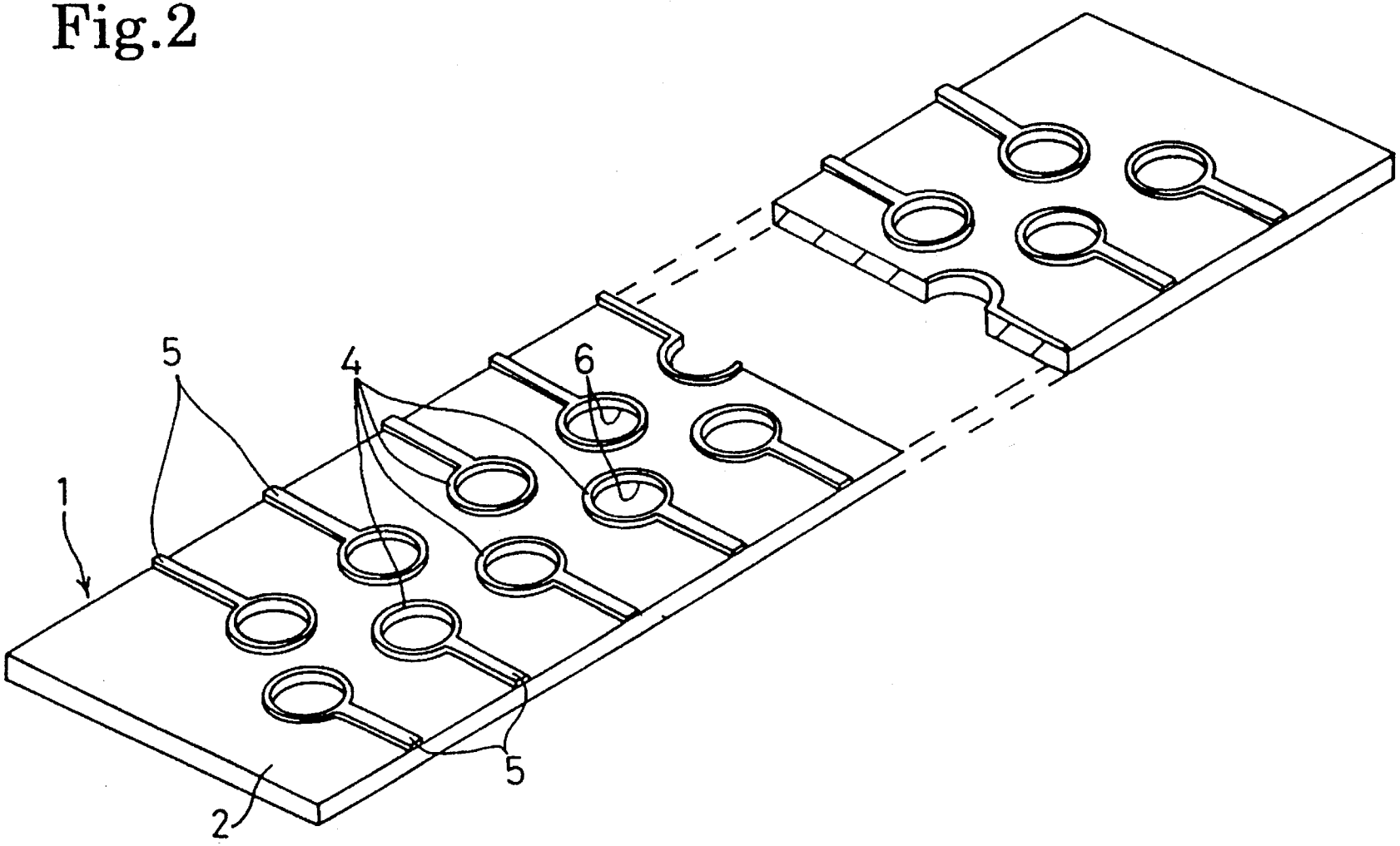
FIG. 2 is a perspective view in partial section showing the construction of an aperture electrode member for use in the image forming apparatus of the preferred embodiment.

As shown in FIG. 2, the aperture electrode member 1 preferably comprises a polyimide insulating sheet 2 of approximately 25 μm thickness, which is formed with plural apertures 6 of approximately 100 μm diameter, as shown in FIG. 2. Control electrodes 4 of approximately 1 μm thickness are formed at the peripheral edge of the opening of each aperture 6 on the upper surface of the insulating sheet 2. The apertures 6 are disposed on two offset lines, which extend in parallel to each other and are spaced from each other at an interval in the width direction of the insulating sheet 2. The apertures 6 on the respective lines are positionally deviated from one another in the direction perpendicular to the feeding direction of the printing medium 20 so that they do not overlap with each other (i.e., are not straightly aligned with each other) in the feeding direction of the printing medium 20. Thus, recording density of an image is improved.

Figure 3:
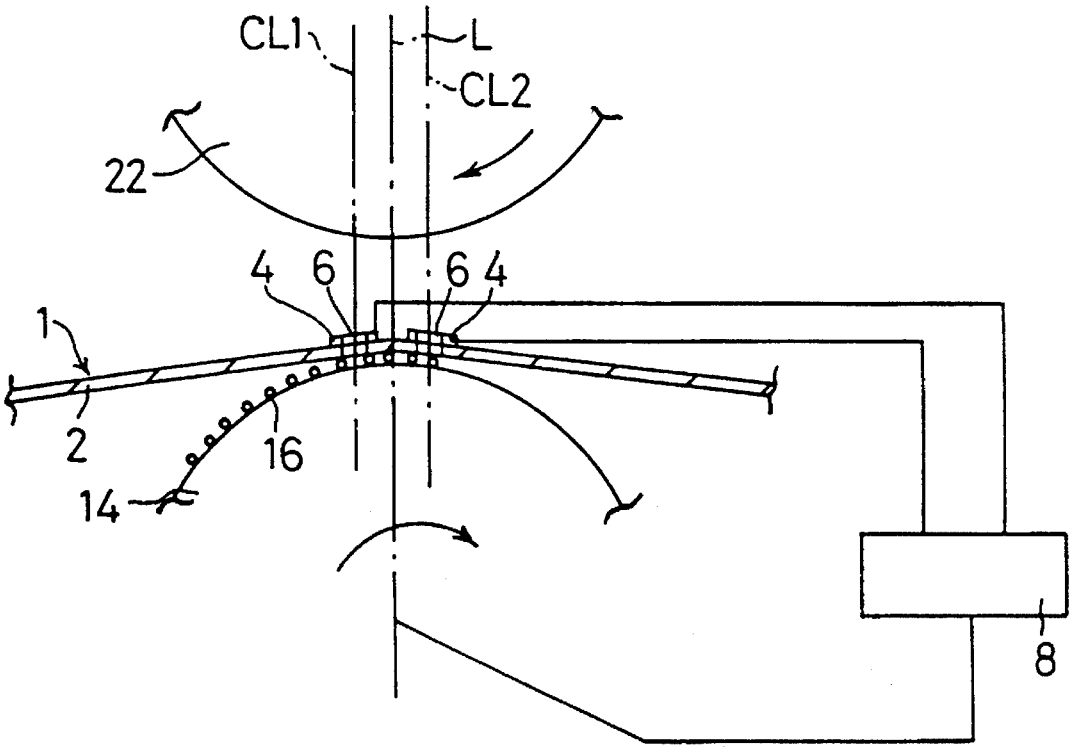
FIG. 3 is an enlarged partial side view of a main part of the image forming apparatus of the preferred embodiment.
Figure 4:
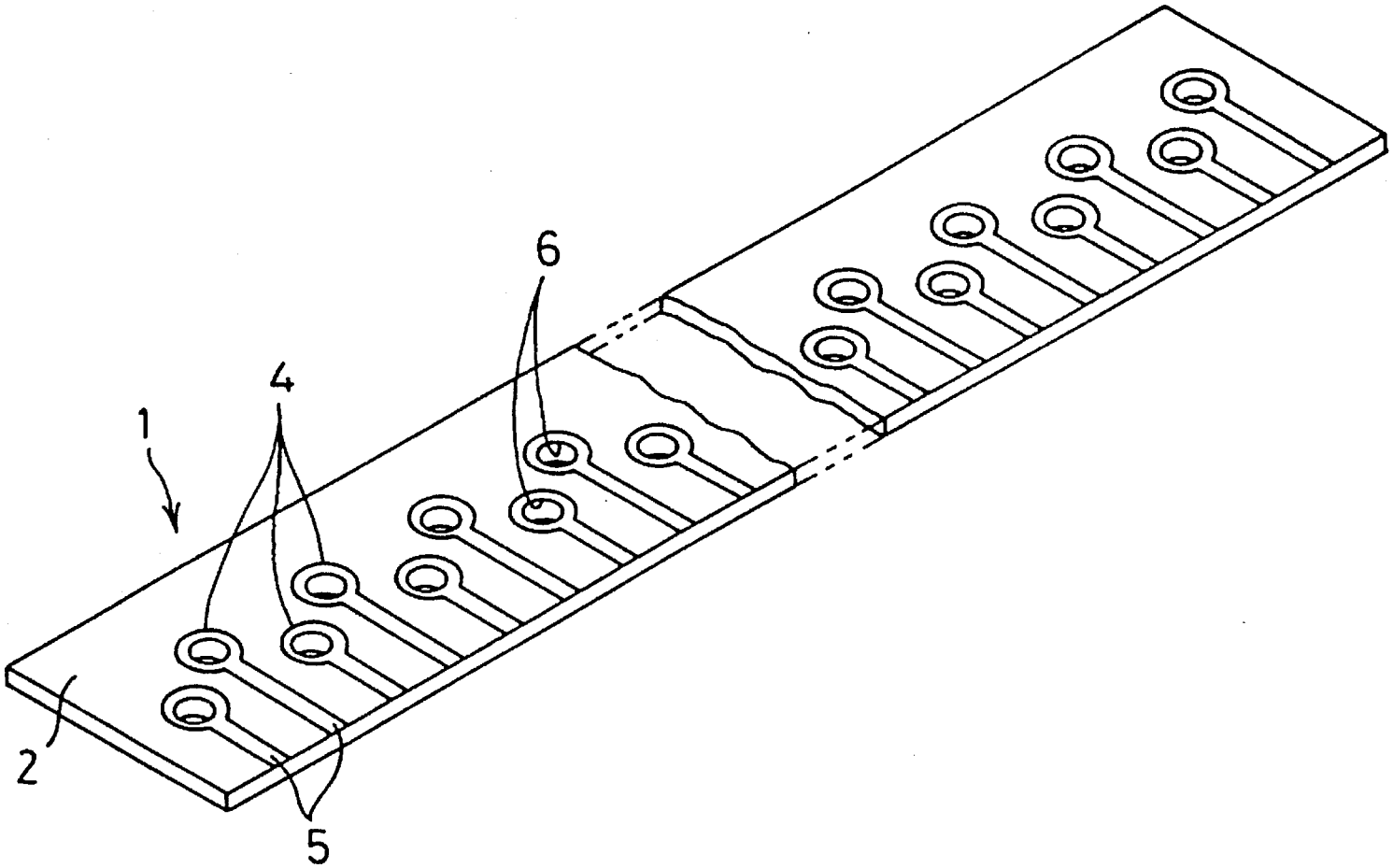
FIG. 4 is a perspective view in partial section showing the construction of another embodiment of the aperture electrode member.

The details of the positional relationship between the apertures 6 of the aperture electrode member 1 and the toner carry roller 14 are described as follows. As shown in FIG. 3, the aperture electrode member 1 contacts the toner carry roller 14 through the toner 16 carried on the toner carry roller 14 while the control electrodes 4 confront the back electrode roller 22. The aperture electrode member 1 is disposed so that the center portion of the gap between the two arrays of the apertures is located on a line L as shown in FIG. 3. Here, the line L is defined as a line that connects the center of the toner carry roller 14 and the center of the back electrode roller 22. That is, as shown in FIG. 3, an aperture center line CL1 at the upstream side of the feeding direction of the printing medium 20 and an aperture center line CL2 at the downstream side of the feeding direction are respectively equally spaced from the line L. Further, the insulating sheet 2 is pressed against the toner carry roller 14 so that the right and left sides of the insulating sheet 2 with respect to the line L in FIG. 3 are intersected by the line L by the same angle.

A control voltage applying circuit 8 is connected across the control electrodes 4 and the toner carry roller 14. The control voltage applying circuit 8 is designed to apply a voltage of approximately 0 V or +50 V to the control electrodes 4 on the basis of an image signal.

In general, when two arrays of apertures are arranged on the insulating sheet 2 at a gap interval in the rotational direction of the toner carry roller 14, unevenness of density may occur if the contact state of the toner carry roller and one of the aperture arrays located at the upstream and downstream sides of the feeding direction of the printing medium 20 is different from the contact state of the toner carry roller and the other aperture array. However, in this embodiment, the distance from the line L to the aperture center line CL1 at the upstream side is equal to that from the line L to the aperture center line CL2 at the downstream side. So, the toner 16 uniformly contacts the respectively aperture arrays located at the upstream and downstream sides. Thus, the toner supply can be conducted on both of the aperture arrays in the same state at all times.

Further, a DC power source 24 is connected across the back electrode roller 22 and the toner carry roller 14. The DC power source 24 applies a voltage of +1 kv to the back electrode roller 22.

In operation, first upon rotation of the toner carry roller 14 and the supply roller 12 in the directions as indicated by the arrows as shown in FIG. 1, the toner 16 fed from the supply roller 12 is rubbed against the toner carry roller 14 and negatively charged. Then, it is carried on the toner carry roller 14. The carried toner 16 is thin-layered by the layer adjusting blade 18 and charged. Then, it is fed toward the aperture electrode member 1 by the rotation of the toner carry roller 14. The toner on the toner carry roller 14 is supplied to the lower side of each aperture 6 while being rubbed against the insulating sheet 2 of the aperture electrode member 1.

Here, in accordance with the image signal, a voltage of +50 V is applied to the control electrodes 4 corresponding to an image portion by the control voltage applying circuit 8. As a result, an electric line of force directed from the control electrodes 4 to the toner carry roller 14 is formed in the neighborhood of the apertures 6 corresponding to the image portion by the potential difference between the control electrodes 4 and the toner carry roller 14. Accordingly, an electrostatic force directing to a higher potential side is applied to the negatively charged toner. So, the toner is electrostatically attracted from the surface of the toner carry roller 14 through the apertures 6 to the control electrodes 4 side. The attracted toner 16 at the control electrode 4 side is further attracted and thus transfers toward the printing medium 20 by the electric field generated between the printing medium 20 and the aperture electrode member 1 due to the voltage applied to the back electrode roller 22. The toner 16 is then deposited on the printing medium 20, thereby forming an image on the printing medium 20. At this time, the toner 16 is uniformly supplied to the aperture arrays 6 at the upstream and downstream sides. Thus, a uniform and high-quality image can be formed.

Further, a voltage of 0V is applied from the control voltage applying circuit 8 to the control electrodes 4 corresponding to a non-image portion. As a result, no electric field occurs between the toner carry roller 14 and the control electrodes 4. Thus, no electrostatic force is applied to the toner 16 on the toner carry roller 14, so the toner is not passed through the apertures 6.

The printing medium 20 is fed in the direction perpendicular to the aperture arrays by a length corresponding to one image while an image on a line (row) is formed on the printing medium 20 with the toner 16. Further, by repeating the above process, a toner image can be formed on the whole surface of the printing medium 20. Thereafter, the toner thus formed is fixed on the printing medium 20 by the fixing device 26.

If insulating toner is used in the image forming apparatus thus constructed, the insulation between the toner carry roller 14 and the control electrodes 4 is maintained. So, the apertures 6 can .be prevented from being broken.

In the above process, the control electric field by the control electrodes 4 is formed inside of the control electrodes 4 and the apertures 6 and between the apertures 6 and the toner carry surface of the toner carry roller 14, which confronts the apertures 6. Thus, the control electric field can be directly applied to the carried toner 16. So, control efficiency can be improved.

Further, even when a part of the supplied toner 16 is subjected to a mechanical force or the like through the sliding motion between the toner 16 and the aperture electrode member I and it invades into the apertures 6 corresponding to the non-image portion, the toner can be controlled to not pass through the apertures 6 by the electric field occurring in the apertures 6. So, the control performance of the toner can be improved.

In addition, the toner carry roller 14 and the aperture electrode member 1 are disposed to confront each other through the toner layer. Thus, these elements can be disposed at a relatively short distance. Accordingly, the control voltage can be reduced, and inexpensive drive elements can be used.

Moreover, the insulating sheet 2 of the aperture electrode member 1 is disposed to face the toner carry roller 14 side. Accordingly, even when no toner 16 is supplied onto the toner carry roller 14 because of failure of the toner supply system, the contact of the control electrodes 4 and the toner carry roller 14, that is, the short-circuit of these elements, can be prevented. Thus, the driving elements can be prevented from being broken.

Further, the aperture electrode member 1 and the toner 16 on the toner carry roller 14 contact each other at the inlet ports of the apertures. Thus, the toner that is deposited at the inlet ports of the apertures 6 is pushed out by the toner that is successively supplied from the toner carry roller 14. So, clogging of the apertures 6 due to deposition and bridging of the toner 16 does not occur.

This invention is not limited to the above embodiment, and various modifications may be made to the embodiment without departing from the subject matter of this invention.

For example, the control voltage to be applied to the apertures 6 corresponding to the non-image portion is set to 0 V, however, the control voltage may be set to a negative value. By applying a negative voltage, an image having reduced fog can be obtained. In addition, in the above embodiment, the aperture electrode member 1 is used as the toner flow control means. In place of this aperture electrode member 1, a mesh-shaped electrode member, as disclosed in the specification of U.S. Pat. No. 5,036,341for example, may be used.

Further, in the above embodiment, two arrays of apertures that are disposed in parallel to each other are provided. However, three or more aperture arrays may be disposed in the same separate arrangement as described above. If the number of aperture arrays is an odd number, the aperture array at the center is located on the line L as described above.

In the above embodiment, as shown in FIG. 2, conductive portions 5 that extend from the control electrodes 4 of the aperture array at the upstream side of the toner feeding direction of the toner carry roller 14 extend to the edge portion of the aperture electrode member 1 at the upstream side of the toner feeding direction. Other conductive portions 5 that extend from the control electrodes 4 of the aperture array at the downstream side of the toner feeding direction of the toner carry roller 14 extend to the edge portion of the aperture electrode member 1 at the downstream side of the toner feeding direction. However, these conductive portions 5 may be provided to extend from the control electrodes 4 of both aperture arrays to the same edge portion of the aperture electrode member 1 at the downstream side of the toner feeding direction.

What is claimed is:

1. An image forming apparatus comprising:

carrier means for carrying and supplying charged toner particles and having a central toner particle transfer point;

back electrode means for attracting the charged toner particles from said carrier means, said back electrode means facing and spaced from said carrier means so that an image receiving member can be positioned between said carrier means and said back electrode means to receive charged toner particles and form an image, said back electrode means having a central toner particle transfer point aligned with said central toner particle transfer point of said carrier means; and toner flow control means for controlling a flow of charged toner particles from said carrier means to said back electrode means disposed between said back electrode means and said carrier means and confronting and contacting said carrier means, said toner flow control means comprising a plurality of arrays of control units, each array including a plurality of aligned openings disposed at predetermined intervals extending in a direction substantially perpendicular to a feeding direction of the image receiving member and a control electrode provided around each opening, wherein each array is equally spaced from a reference line extending between said central toner particle transfer points of said carrier means and said back electrode means, and wherein said toner flow control means is pressed against said carrier means so that right and left sides of said toner flow control means with respect to the reference line are inclined at a same angle from the feeding direction.

2. The image forming apparatus of claim 1 wherein each array is equally spaced from the reference line in a direction substantially parallel with the feed direction of the image receiving member.

3. The image forming apparatus of claim 1 wherein a distance from a center of an opening in one array to the reference line and a distance from an opening in another array to the reference line is the same.

4. The image forming apparatus of claim 1 wherein the openings in each array are offset from the openings in an adjacent array.

5. The image forming apparatus of claim 1 wherein the control electrodes have conductive portions coupled to a power source, wherein said conductive portions of each array extend in the same direction across said toner flow control means.

6. The image forming apparatus of claim 1 wherein the control electrodes have conductive portions coupled to a power source, wherein said conductive portions of one array extend in an opposite direction than the conductive portions of an adjacent array.

7. The image forming apparatus of claim 1 wherein said toner flow control means is an insulating sheet.

8. The image forming apparatus of claim 1 wherein said plurality of arrays comprise two substantially parallel arrays.

9. The image forming apparatus of claim 1 wherein said carrier means comprises a charged carrier roller.

10. The image forming apparatus of claim 1 wherein said back electrode means comprises a back electrode roller.

11. An image forming apparatus comprising:

a toner supply that supplies charged toner particles;

a back electrode facing said toner supply that attracts a flow of charged toner particles from said toner supply, said back electrode and said toner supply defining a feeding path therebetween for an image receiving member to travel therethrough in a feeding direction and collect charged toner particles from the flow to form an image, wherein the toner supply and the back electrode confront at a toner transfer point; and a toner flow controller disposed between said toner supply and said back electrode to control the flow of charged toner particles therebetween, the toner flow controller comprising at least one pair of arrays, each array including a plurality of aligned flow openings with control electrodes, wherein each array is equally spaced from the toner transfer point along a line extending generally parallel to the feeding direction, and wherein the toner flow controller is pressed against the toner supply so that the aligned flow openings in each array are inclined from the toner transfer point at an angle with respect to the line extending generally parallel to the feeding direction, the angle being the same for each array.

12. The image forming apparatus of claim 11 wherein a distance from a center of a flow opening in one array in the at least one pair of arrays to the toner transfer point and a distance from a flow opening in the other array in the at least one pair of arrays to the toner transfer point is the same.

13. The image forming apparatus of claim 11 wherein the openings in each array are offset from the openings in an adjacent array.

14. The image forming apparatus of claim 11 wherein the control electrodes have conductive portions coupled to a power source, wherein the conductive portions of each array extend in the same direction across the toner flow controller.

15. The image forming apparatus of claim 11 wherein the control electrodes have conductive portions coupled to a power source, wherein the conductive portions of one array extend in an opposite direction than the conductive portions of an adjacent array.

16. The image forming apparatus of claim 11 wherein the toner flow controller is an insulating sheet.

17. The image forming apparatus of claim 11 wherein the toner flow controller is an insulating polyimide sheet.

18. The image forming apparatus of claim 11 wherein the toner supply comprises a charged carrier roller.

19. The image forming apparatus of claim 11 wherein the back electrode comprises a back electrode roller.

* * * * *